US009827466B2

(12) United States Patent
DuFaux et al.

(10) Patent No.: US 9,827,466 B2
(45) Date of Patent: Nov. 28, 2017

(54) MODULUS TRANSITION LAYERS FOR STIFF CORE GOLF BALLS

(71) Applicant: ONCORE GOLF TECHNOLOGY, INC., Buffalo, NY (US)

(72) Inventors: Douglas P. DuFaux, Orchard Park, NY (US); Timothy M. Owens, Summerville, SC (US)

( * ) Notice: Subject to any disclaimer, the term of this patent is extended or adjusted under 35 U.S.C. 154(b) by 0 days.

(21) Appl. No.: 15/312,674

(22) PCT Filed: May 21, 2015

(86) PCT No.: PCT/US2015/031982
§ 371 (c)(1),
(2) Date: Nov. 21, 2016

(87) PCT Pub. No.: WO2015/179645
PCT Pub. Date: Nov. 26, 2015

(65) Prior Publication Data

US 2017/0182370 A1 Jun. 29, 2017

Related U.S. Application Data

(60) Provisional application No. 62/001,246, filed on May 21, 2014.

(51) Int. Cl.
*A63B 37/04* (2006.01)
*A63B 37/00* (2006.01)

(52) U.S. Cl.
CPC ..... *A63B 37/0076* (2013.01); *A63B 37/00* (2013.01); *A63B 37/0003* (2013.01); *A63B 37/0011* (2013.01); *A63B 37/04* (2013.01); *A63B 37/0054* (2013.01); *A63B 37/0056* (2013.01)

(58) Field of Classification Search
CPC ..... A63B 37/0076; A63B 37/0003; A63B 37/0011; A63B 37/00; A63B 37/0054; A63B 37/0051; A63B 37/0056; A63B 37/02; A63B 37/04
See application file for complete search history.

(56) References Cited

U.S. PATENT DOCUMENTS

| | | | | |
|---|---|---|---|---|
| 6,354,966 | B1 * | 3/2002 | Takemura | A63B 37/0003 473/370 |
| 7,014,575 | B2 | 3/2006 | Sullivan et al. | |
| 2002/0019268 | A1 * | 2/2002 | Tsunoda | A63B 37/0003 473/351 |
| 2004/0142767 | A1 * | 7/2004 | Moriyama | A63B 37/0003 473/371 |
| 2006/0178232 | A1 * | 8/2006 | Owens | A63B 37/04 473/371 |
| 2006/0252577 | A1 * | 11/2006 | Sullivan | A63B 37/0003 473/354 |

(Continued)

*Primary Examiner* — John E Simms, Jr.
(74) *Attorney, Agent, or Firm* — Hodgson Russ LLP

(57) ABSTRACT

A golf ball is provided that includes at least two layers of material disposed between a spherical core and a cover layer, wherein the elastic modulus of each is within three orders of magnitude of each adjacent layer or core. The spherical core can be a hollow metal core. This results in a golf ball that is legal for play and capable of drive distances essentially equivalent to those of currently available high performance golf balls, but also provides a golf ball that has less hook and slice during play.

20 Claims, 2 Drawing Sheets

(56) References Cited

U.S. PATENT DOCUMENTS

| | | | | |
|---|---|---|---|---|
| 2007/0161434 | A1* | 7/2007 | DuFaux | A63B 37/0003 473/371 |
| 2008/0057332 | A1* | 3/2008 | Owens | A63B 37/0054 428/544 |
| 2008/0171616 | A1* | 7/2008 | DuFaux | A63B 37/0003 473/373 |
| 2008/0207354 | A1* | 8/2008 | DuFaux | A63B 37/0003 473/373 |
| 2009/0170634 | A1* | 7/2009 | Loper | A63B 37/0003 473/373 |

* cited by examiner

MODULUS TRANSITION LAYERS FOR STIFF CORE GOLF BALLS

CROSS-REFERENCE TO RELATED APPLICATIONS

This application claims priority to the provisional patent application filed May 21, 2014 and assigned U.S. App. No. 62/001,246, the disclosure of which is hereby incorporated by reference.

FIELD OF THE DISCLOSURE

This disclosure relates to an improved multi-piece golf ball.

BACKGROUND OF THE DISCLOSURE

In order to meet the United States Golf Association ("USGA") specifications, a golf ball must be spherical in shape and have equal aerodynamic properties and equal moments of inertia about any axis through its center. The ball must have a minimum diameter of 1.68 inches (4.267 cm), a maximum weight of 1.620 ounces (45.926 g), a maximum initial ball velocity of 255 feet per second, and travel a limited distance as measured on a standard USGA ball testing machine.

Until recent years, most commercially available golf balls have been two-piece or three-piece designs. Two-piece golf balls are comprised of a solid elastomeric core and a cover. Three-piece golf balls are comprised of a central core, which may be solid or liquid filled, surrounded by a polymeric material and a cover, or include a large diameter core and a two-layer cover. Three-piece golf balls also include wound balls, although this type of golf ball is no longer commercially available from major manufacturers. Other more recent designs, however, include four-piece and five-piece golf balls with most of these designs focusing on the layers near the cover layer.

Independent of configuration, most commercially available golf balls are made of nonmetallic materials such as elastomers, ionomer resins, polyurethanes, polyisoprenes, and nylons. Except for wound balls, these golf balls are made by injection molding and/or compression molding one layer around the core and/or around another layer. In order to obtain optimum playing characteristics, such as spin control and improved accuracy (i.e., fewer hooks and slices without sacrificing distances), golf ball designs and their materials of manufacture are becoming increasingly complicated.

The presence of a relatively incompressible metal core in a golf ball subjects the surrounding polymer layer to unusual conditions and stresses that are not encountered in golf balls having compressible polymer cores. When a golf club strikes a metal core golf ball, the polymer layer is compressed against the metal core, and since the core does not yield to any significant degree, the polymer tends to be displaced in a direction parallel to the surface of the core. An excessive amount of such displacement can break the bond between the core and the surrounding polymer layer, resulting in delamination. The polymer may also be fractured by the unusually large stresses put upon it when compressed between a face of a golf club and a metal core.

Depending on the design, hollow metal core golf balls may have shortcomings, including the aforementioned low durability, hard feel, and a small loss of distance compared to more typical molded balls discussed above. Accordingly, there is a need for golf balls that have a hollow metal core that do not exhibit some or all of the shortcomings of these golf balls appearing in the art. Furthermore, there is a need for materials that allow a golf ball designer to use high stiffness cores, while avoiding the shortcomings observed in such golf balls. In addition, there is, accordingly, a need for polymer compositions and/or design approaches that are especially adapted for use with metal core golf balls. Perhaps most importantly, needs should be met in a manner that allows an economical means of production.

BRIEF SUMMARY OF THE DISCLOSURE

In a first instance, a golf ball is provided. The golf ball includes a cover layer, a spherical core, and an innermost mantle layer and an outermost mantle layer disposed between the spherical core and the cover layer. The cover layer has an outer surface defining a plurality of dimples and an inner surface opposite the outer surface. The spherical core has an outer surface disposed within the cover layer and a stiffness of at least 1 GPa. The innermost mantle layer has an inner surface disposed on the outer surface of the spherical core. The outermost mantle layer has an outer surface disposed on the inner surface of the cover layer. The spherical core and the innermost mantle layer have an elastic modulus within three orders of magnitude of each other. Each of the cover layer, the outermost mantle layer, and the innermost mantle layer has an elastic modulus within three orders of magnitude of each adjacent layer.

The spherical core may be a hollow metal core, such as one fabricated of at least one of titanium, a titanium alloy, steel, stainless steel, a steel alloy, or aluminum. The cover layer may be fabricated of at least one of an ionomer resin, urethane, balata, polybutadiene, or another synthetic elastomer. The outermost mantle layer and the innermost mantle layer may include a polymer.

An additional mantle layer may be disposed between the innermost mantle layer and the outermost mantle layer. The additional mantle layer may have an elastic modulus within three orders of magnitude of any of the innermost mantle layer and the outermost mantle layer that the additional mantle layer is adjacent.

The spherical core and the innermost mantle layer may have an elastic modulus within two orders of magnitude of each other. Each of the cover layer, the outermost mantle layer, and the innermost mantle layer may have an elastic modulus within two orders of magnitude of each adjacent layer.

The spherical core and the innermost mantle layer may have an elastic modulus within one-and-a-half orders of magnitude of each other. Each of the cover layer, the outermost mantle layer, and the innermost mantle layer may have an elastic modulus within one-and-a-half orders of magnitude of each adjacent layer.

The spherical core may include at least one feature configured to control a vibrational response of the spherical core. The at least one feature may include at least one indentation configured to control a stiffness of the spherical core. The at least one indentation may include a groove.

In a second instance, a golf ball is provided. The golf ball includes a cover layer, a spherical core, and an innermost mantle layer and an outermost mantle layer disposed between the spherical core and the cover layer. The cover layer has an outer surface defining a plurality of dimples and an inner surface opposite the outer surface. The spherical core has an outer surface disposed within the cover layer and a stiffness of at least 1 GPa. The spherical core also includes at least one feature configured to control a vibrational response of the spherical core. The innermost mantle layer has an inner surface disposed on the outer surface of the spherical core. The outermost mantle layer has an outer surface disposed on the inner surface of the cover layer. The spherical core and the innermost mantle layer have an elastic modulus within three orders of magnitude of each other. Each of the cover layer, the outermost mantle layer, and the innermost mantle layer has an elastic modulus within three orders of magnitude of each adjacent layer.

The spherical core may be a hollow metal core, such as one fabricated of at least one of titanium, a titanium alloy, steel, stainless steel, a steel alloy, or aluminum. The cover layer may be fabricated of at least one of an ionomer resin, urethane, balata, polybutadiene, or another synthetic elastomer. The outermost mantle layer and the innermost mantle layer may include a polymer.

An additional mantle layer may be disposed between the innermost mantle layer and the outermost mantle layer. The additional mantle layer may have an elastic modulus within three orders of magnitude of any of the innermost mantle layer and the outermost mantle layer that the additional mantle layer is adjacent.

The spherical core and the innermost mantle layer may have an elastic modulus within two orders of magnitude of each other. Each of the cover layer, the outermost mantle layer, and the innermost mantle layer may have an elastic modulus within two orders of magnitude of each adjacent layer.

The spherical core and the innermost mantle layer may have an elastic modulus within one-and-a-half orders of magnitude of each other. Each of the cover layer, the outermost mantle layer, and the innermost mantle layer may have an elastic modulus within one-and-a-half orders of magnitude of each adjacent layer.

The at least one feature may include at least one indentation configured to control a stiffness of the spherical core. The at least one indentation may include a groove. In an example, at least one of the outer surface and an inner surface of the spherical core may include a plurality of the grooves. In another example, both the outer surface and an inner surface of the spherical core may include a plurality of the grooves.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Figure 1:
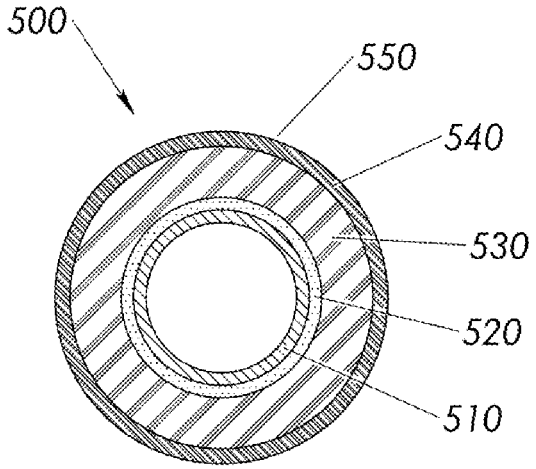
FIG. 1 is a cross-sectional view of an embodiment in accordance with the present disclosure including four material layers: (1) an innermost spherical core comprised of a hollow metal sphere, (2) a first polymeric mantle layer, (3) a second polymeric mantle layer and (4) polymeric cover layer.

Although claimed subject matter will be described in terms of certain embodiments, other embodiments, including embodiments that do not provide all of the benefits and features set forth herein, are also within the scope of this disclosure. Various structural or process step changes may be made without departing from the scope of the disclosure. Accordingly, the scope of the disclosure is defined only by reference to the appended claims.

The present disclosure provides a golf ball having a spherical core or layer and an outer cover layer with a dimpled pattern and polymeric, elastomeric, and/or composite mantle layers disposed between the spherical core and the cover layer such that the elastic modulus of each of the layers or core is within three, two, or one-and-a-half orders of magnitude of an adjacent layer or core.

In one embodiment, the golf ball has a cover layer formed of an ionomeric material or another material that is resistant to damage from external articles of the type normally encountered when playing golf, such as a golf club. The cover layer has an outer surface, defining a dimpled pattern, and an inner surface. The cover layer has a cover thickness between its outer surface and inner surface. The golf ball also includes a spherical core or layer, such as one made from a metal, which has an outer surface and an inner surface. The spherical core or layer, which may be hollow, has a sphere thickness between its outer surface and inner surface. The outer surface of the spherical core can be supported or surrounded by an inner surface of a first polymeric, elastomeric, and/or composite mantle layer. The first mantle layer has an outer surface, which can be supported or surrounded by the inner surface of a second polymeric, elastomeric, and/or composite mantle layer. An outer surface of the second mantle layer can be supported or surrounded by the inner surface of the cover layer. The elastic modulus of each of the cover layer, first and second mantle layers, and spherical core is within three, two, or one-and-a-half orders of magnitude of each adjacent layer or core.

In another embodiment, the golf ball may include three, four, five, or more polymeric, elastomeric, and/or composite mantle layers between the spherical core and the cover layer. The elastic modulus of each of the layers or the spherical core is within three, two, or one-and-a-half orders of magnitude of each adjacent layer or core.

In an embodiment, the spherical core includes at least one feature for controlling the stiffness of the spherical core. The golf ball also includes a cover layer with a dimpled pattern and polymeric, elastomeric, and/or composite mantle layers disposed between the spherical core and the cover layer such that the elastic modulus of each of the layers or the spherical core is within three, two, or one-and-a-half orders of magnitude of each adjacent layer or the spherical core. The feature in or on the spherical core can be a groove or grooves, which serve to locally reduce the wall thickness of the spherical core, thereby reducing the stiffness of the hollow metal spherical core by allowing larger deformations under a given load without significantly reducing the total mass of the spherical core.

In a particular embodiment, the spherical core in a golf ball is a hollow metal core. A one-piece hollow metal sphere is surrounded by at least one mantle layer and a cover layer. Such a golf ball having a hollow metal sphere can be made by hot forming or cold forming two halves of a sphere, which are securely joined together by various welding techniques or other means known to those skilled in the art. This golf ball design exhibits less hook and slice with a missed hit. The one-piece hollow metal sphere, which is surrounded by at least one polymer mantle layer, is capable of withstanding the hardest impacts from current titaniumfaced golf clubs. Due to the presence of the high stiffness hollow metal sphere, the polymer mantle layer and cover layer are subject to a different set of stresses when struck by a golf club compared to a conventional ball, which results in the unique flight characteristics.

The inventors have shown that time on the golf club face, initial velocity, backspin, side spin, and rifle spin can be modified due to the presence of the hollow metal sphere, the mantle layers, and the cover layer. Depending on the type of golf swing, back spin variations may be advantageous, for example. For a golfer with a low swing speed and low launch angle, a high back spin rate will provide longer distance to the shots. Rifle spin can provide for less hook and slice because it creates a gyro stabilizing force. High back spin also may be advantageous by allowing the golf ball to bite on a surface.

During a high-speed collision between a golf ball and golf club, the golf ball undergoes deformation such that the core of the golf ball deforms from a spherical shape to an oblong shape. At the point of maximum deflection of the golf ball, the golf ball and the golf club head travel together for a period of time at the same velocity. After this point, the golf ball projects forward, accelerating off of the face of the golf club due to the elastic nature of the golf ball. Based on the coefficient of restitution (COR) of the golf ball and the relative weight of the golf club head to that of the golf ball, the golf ball travels at a faster speed than the golf club head. The initial velocity of the golf ball can be approximated with the following Equation 1:

$$v = U \times \frac{1 + COR}{1 + (m/M)} \quad [1]$$

where v is the velocity of the ball immediately after impact, U is the velocity of the golf club head immediately before impact, m is the mass of the ball, M is the mass of the golf club head, and COR is the coefficient of restitution of the golf ball.

The COR of a golf ball is determined empirically. The golf ball is launched at a predetermined velocity ($v_{(initial)}$) toward a flat rigid object, such as a large steel plate fixed to a wall, and the velocity is measured after the golf ball bounces off of the plate ($v_{(final)}$) in a manner such that the impact is perpendicular to the plate. The COR is calculated as shown in Equation 2:

$$COR = v_{(final)} / v_{(initial)} \quad [2]$$

COR can determine the elasticity of a golf ball and the value lies between an ideal case where all the energy at impact is returned to the ball and the final velocity matches the initial velocity with COR equal to 100% or 1.0 and the case where none of the energy at impact is returned to the golf ball and the final velocity is zero (i.e., the golf ball simply drops to the floor) and COR equals 0% or 0. The COR of a typical polymeric golf ball is around 70% to 85%. COR may change over the range of initial velocities. Thus, COR at an impact velocity of 10 meters per second may be different than the COR at an impact speed of 50 meters per second.

If the COR of the golf ball for a given collision is high (i.e., near 1.0 or 100%), then very little of the kinetic energy is lost during the collision. However, if the COR in a given collision is low, then more kinetic energy is lost during the collision. This energy loss results from internal friction between the polymeric molecules as the golf ball deforms from the spherical shape to an elongated sphere during maximum deflection, and back to the spherical shape after impact.

The inventors have observed that in some instances, depending on the materials used for construction, the COR of golf balls with hollow metal cores having a smooth surface or surfaces can be much less than 100% and in some cases ranging as low as 40%. The inventors have also determined that a large fraction of the energy losses after impact are attributed at least in part to vibrations. That is, after impact the metal sphere can be seen as being displaced about an equilibrium position (e.g., from an essentially perfect sphere to an elongated sphere) and will oscillate about this equilibrium position until internal and external frictional forces cause the vibration to decay. These vibrations are generally converted to thermal energy, although not generally detectable to human touch.

One parameter that plays a role in the vibrational response of a golf ball having a hard sphere core is the stiffness of the core and each subsequent layer. The stiffness may be attributed to either the properties of the material used to construct the a core or given layer, such as the hardness, modulus of elasticity, toughness, etc., or properties associated with the shape and size of the core and subsequent layers, such as the moment of inertia, the section modulus, etc. The ability to minimize or otherwise reduce vibrational losses will generally reduce the kinetic energy from the impact that is lost, thereby increasing the COR of the golf ball.

The following Equation 3 describes the deflection response of a three piece golf ball when struck during a high impact collision. It should be noted that although the equation describes the deflection of a three-piece golf ball, the analysis is equally valid for a two-piece golf ball by setting the portion relating to the mantle layer to zero, or other multi-piece golf balls by proper equation adjustments that add additional deflection variables.

$$D = (d_{cover} + d_{mantle} + d_{core}) \quad [3]$$

where D=the total deformation of the ball, $d_{cover}$ is the deflection of the cover layer, $d_{mantle}$ is the deflection of the mantle layer, and $d_{core}$ is the deflection of the hollow sphere core, each of which is a function of the force (F) applied to the ball. The deflections of the cover, mantle layer, and core all can be non-linear functions of the applied force, thickness of the layer, configuration, and materials of construction, respectively.

The high stiffness spherical core and a resilient mantle layer of a three piece golf ball tends to deflect in a linear manner for small loads, and becomes increasingly stiff and therefore non-linear as the load increases. In the case of a metal or hollow metal core, it is linear in its response to much higher loads. For example, the response may be linear to the point of yield failure. As a result, for shorter shots approaching the green, which are not struck as hard as drives, the cover and the mantle can provide a higher relative fraction of the deformation of the ball than they do in a drive which exerts much higher forces to the ball. Therefore, a golf ball can be thought of as exhibiting a variable spring constant, with the constant being primarily defined by the cover and mantle layers for low energy impacts and increasingly more influenced by a hollow metal core for high energy impacts.

Stiffness is related to the vibrational response of an object. The following Equation 4 for a simple harmonic oscillator relates the stiffness of a spring to various damping factors (including certain frictional forces) and the resulting vibrational response:

$$\frac{d^2x}{dt^2} + b\frac{dx}{dt} + \omega_o^2 x = A_o\cos(\omega t) \quad [4]$$

where t is time, b is the damping constant, $\omega_o$ is the characteristic angular frequency (equal to $2\pi f_o$, where f is frequency in cycles per second), $A_o\cos(\omega t)=A_o\cos(2\pi ft)$ and is the driving force with an amplitude of $A_o$ and an angular frequency of ω, and x is the position.

Because the force exerted on a golf ball may be considered an impact or impulse force, the initial conditions (t=0) are such that the right hand side of Equation 4 is zero. Focusing on the left hand side of Equation 4, the damping coefficient and characteristic angular frequency can be important variables for design considerations in terms of controlling the response of the golf ball. Since the damping coefficient may not determine the amount of energy coupled to the vibrational losses of the system, only the rate at which it is dissipated as heat, this shows that the characteristic frequency can be the primary variable for designers to reduce energy losses associated with vibration. Characteristic frequency is a function of the stiffness or spring constant, as well as the state of the pre-stress compression or tension forces.

The inventors have determined that by increasing the amount of deflection that the golf ball exhibits for a given impact, without decreasing the diameter of the layers (e.g., by decreasing the stiffness of the golf ball), the COR of the ball may be increased to greater than about 70%, greater than about 85%, greater than about 90%, or even closer to unity. Thus, increasing defection would provide additional design parameter without an associated increase in the golf ball's tendency to hook or slice.

In addition to vibrational characteristics, durability is a key design consideration for high stiffness core golf balls. The normal force at impact between a golf ball and a golf club when the average golfer strikes the ball can be on the order of 2000 lbs. Thus, durability of the materials in a golf ball must be able to withstand this impact force many times while retaining their original shape following impact and without degradation of the ball's COR. For golf balls with highly stiff cores, achieving a golf ball with good energy transfer between layers and sufficient durability is a challenge.

For example, it has been observed that the layer or layers surrounding the core in a golf ball incorporating a highly stiff core, such as a hollow metal core, may fracture upon repeated impact by a golf club at swing speeds that are typical of the average golfer. The transfer of useful energy upon impact between the layers may be reduced due to the fracturing or other degradation of materials. One contributing factor for this degradation is the large differential elastic modulus between the separate layers.

The present disclosure therefore generally provides golf balls having a cover layer with a dimpled pattern, a high stiffness spherical core, and polymeric, elastomeric, and/or composite mantle layers disposed between the core and the cover layer such that the elastic modulus of each layer or core is within three, two, or one-and-a-half orders of magnitude of each adjacent layer or core.

Examples of polymeric, elastomeric, and/or composite materials that can be used in the mantle layers are shown in the following table. Other materials are possible. The flexural modulus can vary from the values or ranges listed depending on, for example, manufacturing conditions or additives.

| Material | Flexural Modulus (MPa) |
|---|---|
| DuPont HPF 1000 | 220 |
| DuPont HPF 2000 | 86 |
| DuPont HPF AD 1035 | 50 |
| DuPont HPF AD 1172 | 45 |
| DuPont SURLYN ® 7XXX Grades | 420-460 |
| DuPont SURLYN ® 8XXX Grades | 30-517 |
| DuPont SURLYN ® 9XXX Grades | 30-427 |
| Polybutadiene Rubber | 5-100 |
| Acrylonitrile Butadiene Styrene (ABS) | 2344 |
| DuPont DELRIN ® Plastics | 2800-5000 |
| High-density Polyethylene (HDPE) | 1151 |
| Low-density Polyethylene (LDPE) | 197 |
| St. Gobain Meldin Polyamides | 31716-53090 |
| Nylon 12 | 1641 |
| Nylon 6 Impact Modified | 2275 |
| Nylon 6 Natural | 2896 |
| Nylon 6 Oil Filled | 2586 |
| Nylon 6/6 30% Glass Filled (GF) | 4695 |
| Nylon 6/6 Super Tough | 1586 |
| Poly Ether Ether Ketone | 3654 |
| Polycarbonate | 2379 |
| Polycarbonate 20% Glass Fiber | 5502 |
| Polycarbonate 40% Glass Fiber | 9653 |
| Polypropylene Copolymer | 1269 |
| Polypropylene Homopolymer | 1465 |
| Polystyrene High Impact | 1655 |
| Polysulfone | 2689 |
| Ultra-high-molecular-weight Polyethylene (UHMW-PE) | 758 |
| Sabic Ultem Poly Ether Polyimides | 3309-8963 |

In the case of hollow metal cores, the elastic modulus of the core may be much higher than the typical modulus range of polymeric/elastomeric materials and it may be necessary to have a transition from the core to the polymeric/elastomeric materials such that the modulus difference between the innermost layer and the hollow metal core is not greater than two orders of magnitude. Molding materials in several steps to produce a multi-component ball with several layers, where each layer is formed of a different combination of materials and/or using processing conditions to form such layers can result in decreasing stiffness from each layer moving out from the stiff core, is one example of a golf ball that achieves this objective. The selection for each layer will generally be determined through experimental and modeling means, testing each layer individually, as well as variations of completed balls.

Selection of a particular elastic modulus for each layer or core may be applied toward two-piece golf balls in which instance the ball will consist of the cover with a hard sphere core, hollow or otherwise. Selection of a particular elastic modulus for each layer or core may also be applied toward other multi-piece designs using greater than two pieces (e.g., three, four, five, etc.

pieces), in which instance the hard sphere may serve as an intermediate layer or as a sphere core, hollow or otherwise.

Referring now to FIG. 1, an improved golf ball 500 in accordance with an embodiment of the present disclosure is illustrated in cross section. The golf ball 500 includes a spherical core 510 which in the embodiment of FIG. 1 is a hollow metal sphere, surrounded by a first mantle layer 520, a second mantle layer 530, and cover layer 540. The outer surface 550 of the cover layer 540 may include surface features such as dimples to increase flight characteristics. The first mantle layer 520 can be referred to as an innermost mantle layer and the second mantle layer 530 can be referred to as an outermost mantle layer.

The spherical core 510 may be a hollow metal sphere. The hollow metal sphere may be made of titanium, titanium alloys, steel, including carbon steel, stainless steel and steel alloys, aluminum, or other metals or metal alloys. The spherical core 510 has an outside diameter ranging from about 0.50 to 1.50 inches (about 1.27 to 3.8 cm), and a thickness from about 0.02 to 0.16 inches (0.05 to 0.41 cm) or from about 0.02 to 0.08 inches (0.05 to 0.20 cm), including all values and ranges therebetween.

For example, a hollow metal core used as the spherical core 510 can have an outer diameter of about 22.86 mm (0.90 inches) or less to comply with new rules issued by the USGA, but the diameter may be any diameter from about 10 mm (0.39 inches) to about 38 mm (1.50 inches), or from about 25.4 mm (1.0 inches) to about 35.6 mm (1.4 inches), including all values and ranges therebetween. The outer surface of the spherical core 510 and the inner surface of the spherical core 510 together define a hollow core thickness, which is may be about 1.82 mm, however the core thickness may range from about 0.5 mm to about 6.4 mm.

The hollow metal core of the spherical core 510 can include 300 and 400 series stainless steels. The hollow metal core can include 301 stainless steel, 302 stainless steel, 304 stainless steel, 430 stainless steel, or 410 stainless steel. Other possible metals include alloy steels such as 4130, 17-4, and 17-7.

The cover layer 540 has an outer surface 550 and an inner surface, which together define a thickness, which is about 4 mm, but may be any thickness between about 1 mm and about 6 mm or between about 2 mm and about 5 mm. The outer surface 550 has a surface dimple pattern and can be made of an ionomer resin (such as SURLYN® manufactured by DuPont), but may be also be made of another ionomer, urethane, balata, polybutadiene, another synthetic elastomer, or any other material suitable for a golf ball cover. The cover layer 540 also forms the golf ball diameter, which is can be 42.67 mm (1.68 inches), to meet USGA and industry standards, but may be any diameter equal to, greater, or less than 42.67 mm. For example, the diameter may be from about 40 mm and about 45 mm, including all values and ranges therebetween.

The first mantle layer 520 and second mantle layer 530 can be, for example, a polyether block amide or a polymeric resin. The polyether block amide can be modified with ceramic material. Other polymers or materials may be used in the first mantle layer 520 and second mantle layer 530.

Instead of the hollow metal core of the spherical core 510, an improved golf ball according to another embodiment of the present disclosure includes a solid spherical core. The solid spherical core may be made of various materials and can be designed to have high stiffness. One set of materials that can be used to create high stiffness cores is a blend of polymer-ceramic composites. Many polymers and ceramics may be used for this type of composite. Injection molded polymers for the core composites include, but are not limited to nylon, polyethylene, polystyrene, and acrylonitrile butadiene styrene (ABS). Ceramics that can be used as the strengthening phase in the polymer matrix composite include, but are not limited to, silicon nitride ($Si_3N_4$), silicon carbide (SiC), titanium diboride ($TiB_2$), titanium carbide (TiC), aluminum oxide ($Al_2O_3$), zirconium oxide ($ZrO_2$), and boron carbide ($B_4C$). Other materials may be as the strengthening phase in the polymer matrix composite as well. For example, carbon fiber, carbon nanotubes (CNTs), graphene, and other materials may provide stiffening of a polymer or elastomer when used in a composite as described above. Furthermore, elastomers may also be employed as the matrix or mixed with a polymer to provide the matrix. Other examples of the polymers in the polymer-ceramic composite include an ethylene (meth)acrylic acid ionomer (such as HPF resin manufactured by DuPont), a polyether block amide (such as PEBAX® resin manufactured by Arkema Group), urethane/polyurethane, and/or polybutadiene. The spherical core 510 may include one or more polymers and one or more strengthening phases. Mixtures of different polymers or strengthening phases are possible. The strengthening phase may be from approximately 5% weight to 80% weight of the spherical core 510, including all values and ranges therebetween.

The spherical core 510 and the first mantle layer 520 have an elastic modulus within three, two, or one-and-a-half orders of magnitude of each other. Each of the first mantle layer 520, second mantle layer 530, and cover layer 540 has an elastic modulus within three, two, or one-and-a-half orders of magnitude of each adjacent layer. Thus, the first mantle layer 520 and second mantle layer 530 have an elastic modulus within three, two, or one-and-a-half orders of magnitude of each other. The second mantle layer 530 and cover layer 540 also have an elastic modulus within three, two, or one-and-a-half orders of magnitude of each other.

Figure 2:
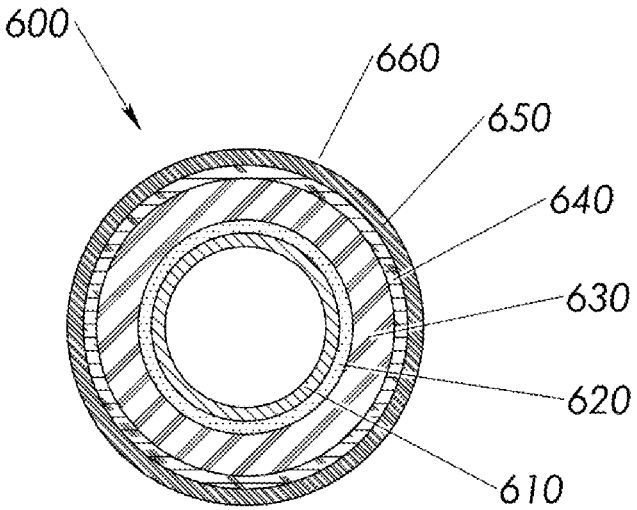
FIG. 2 is a cross-sectional view of an embodiment in accordance with the present disclosure including five material layers: (1) an innermost spherical core comprised of a hollow metal sphere, (2) a first polymeric mantle layer, (3) a second polymeric mantle layer, (4) a third polymeric mantle layer, and (5) polymeric cover layer.

Referring now to FIG. 2, an improved golf ball 600 in accordance with an embodiment of the present disclosure is illustrated in cross section. The golf ball 600 includes a spherical core 610 such as a hollow metal sphere, surrounded by a first mantle layer 620, a second mantle layer 630, a third mantle layer 640, and a cover layer 650. The outer surface 660 of the cover layer 650 may include surface features such as dimples to increase flight characteristics. The first mantle layer 620 can be referred to as an innermost mantle layer and the third mantle layer 640 can be referred to as an outermost mantle layer.

The cover layer 650, mantle layers 620-640, and spherical core 610 in FIG. 2 may be made of similar materials or have similar properties to the cover layer 540, mantle layers 520-530, and spherical core 510 of FIG. 1, respectively.

The spherical core 610 and the first mantle layer 620 have an elastic modulus within three, two, or one-and-a-half orders of magnitude of each other. Each of the first mantle layer 620, second mantle layer 630, third mantle layer 640, and cover layer 650 has an elastic modulus within three, two, or one-and-a-half orders of magnitude of each adjacent layer. Thus, the first mantle layer 620 and second mantle layer 630 have an elastic modulus within three, two, or one-and-a-half orders of magnitude of each other. The second mantle layer 630 and third mantle layer 640 have an elastic modulus within three, two, or one-and-a-half orders of magnitude of each other. The third mantle layer 640 and cover layer 650 also have an elastic modulus within three, two, or one-and-a-half orders of magnitude of each other.

The spherical core of FIGS. 1 and 2 can have a stiffness of at least 1 GPa. Other stiffness values are possible.

An improved golf ball according to another embodiment of the present disclosure can include a thermoplastic elastomer composite (TEC) in one or more of the mantle layers and/or part of the high stiffness core. The TEC is a multi-component polymer material, comprised of at least one injection moldable material, also referred to as the injection moldable fraction, and at least one second phase material dispersed throughout the injection moldable material. The injection moldable material may be any material suitable for injection molding. The second phase material can be an elastomeric material, but may be any other material that is resilient. The TEC may have material characteristics that are a combination of the two materials. More than two types of second phase material can be added to the injection moldable fraction.

In one embodiment, the TEC is comprised of a thermoplastic material and polybutadiene as the second phase. The thermoplastic material may comprise one or more polymers from the following group, an ethylene (meth)acrylic acid ionomer (such as HPF resin manufactured by DuPont), a polyether block amide (such as PEBAX® resin manufactured by Arkema Group), urethane/polyurethane, and/or other commercially available thermoplastics. The polybutadiene may be blended into the injection moldable fraction by adding particles, fragments, and other forms into a blending extruder or mixed with the polymer in the injection molding system hopper just prior to injection molding.

Optionally, other materials may be added to the two-component or other type of mix to further enhance material properties. One such material is clay of various sizes, including nanometer sized materials. The nanoclay material may be added in the form of a nanocomposite, such as nanoclay particles contained in a polymer carrier.

Nano-materials may also be used to tailor the characteristics of the TEC. Nanomaterials are generally those that exhibit characteristics based on controlling the composition of the material at a sub-micrometer level, to vary the strength, ductility, hardness, formability, crack propagation resistance, etc., or a combination thereof. By varying the amount of dispersions within the TEC, the durability, resilience and other properties may be tailored. Thus, nanosize materials, such as metallic, ceramic, or clay powders, carbon-nanotubes, etc., may be used as the second phase material to carry a portion of the load or interact with the matrix material dislocations or grain boundaries to tailor the strength or stiffness.

From about 1% and 80% by weight or from about 10% and 60% by weight, including all ranges and values therebetween, of the TEC may be polybutadiene or other dispersed phase.

Optionally, it may be desired to reduce the stiffness of a stiff core. In one embodiment of the present disclosure, the stiffness of the core is modified in addition to using transition layers.

In one embodiment, the spherical core has at least one indentation, which may be a groove or other means, for controlling the vibrational response of the sphere, such as for reducing the stiffness or spring constant, or increasing the deflection response of the hard sphere core or layer or increasing the damping coefficient against the hard sphere core or layer as compared to core or layer without the feature.

Figure 3:
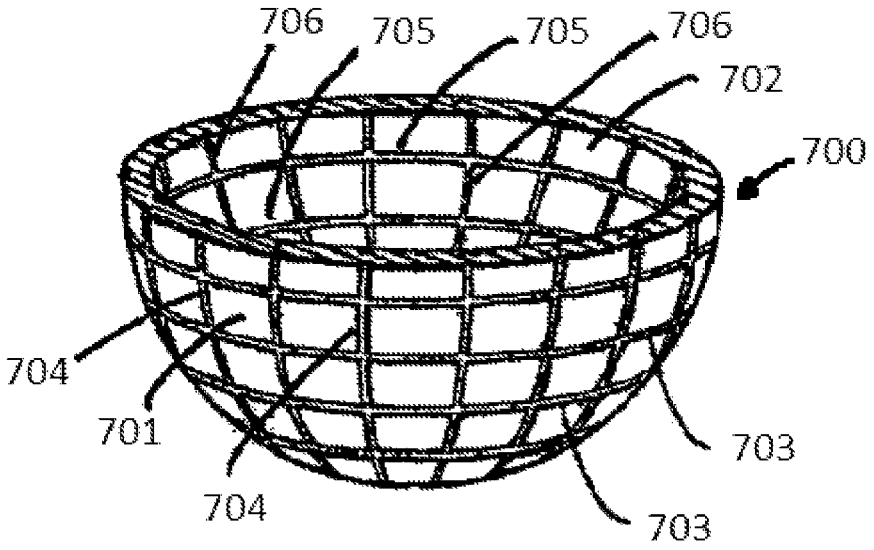
FIG. 3 is a partial cross-sectional view of an embodiment of a spherical core in accordance with the present disclosure.

FIG. 3 is a partial cross-sectional view of an embodiment of a spherical core in accordance with the present disclosure. The spherical core 700 has an outer surface 701 and an inner surfacb 702. The outer surface 701 includes multiple horizontal grooves 703 and vertical grooves 704. The inner surface 702 includes multiple horizontal grooves 705 anertical grooves 706. The grooves 703-706 may have a width of from about 1 nm to about 5 mm, including all values and ranges therebetween. For example, the grooves may be approximately 0.3 mm in width. The depth of the grooves 703-706 may be from about 1 nm to about 5 mm, including all values and ranges therebetween. For example, the grooves may be approximately 0.91 mm in depth. The profile of the grooves 703-706 may be u-shaped, v-shaped, or other shapes.

While illustrated at right angles in FIG. 3, the various grooves can be at other angles relative to each other. Thus, other groove configurations besides those illustrated in FIG. 3 are possible. For example, non-intersecting longitudinal or latitudinal grooves may be used or the grooves may form triangular, circular, or polygonal zones instead of the squares seen in FIG. 3. While grooves 703-706 are illustrated on both the outer surface 701 and inner surface 702, the grooves may only be present on one or the other of the outer surface 701 or inner surface 702.

The golf balls made according to the present disclosure can meet the specifications and rules of the USGA. These golf balls also provide less hook and slice during play and are economical to manufacture.

By configuring the elastic modulus of each of the layers or the spherical core to be within three, two, or one-and-a-half orders of magnitude of each adjacent layer or the spherical core, flight characteristics and durability can be improved. First, this relationship of the relative elastic modulus values can prevent cracking or delamination. The gradual change in elastic modulus values can provide a buffer between the cover layer and the spherical core. For example, the elastic modulus values can step down from the high elastic modulus spherical core to the low elastic modulus cover layer. This step down may or may not be linear. Second, this relationship of the relative elastic modulus values can control energy loss at the interfaces between the various layers and the spherical core. This may increase the contribution of the spherical core when the golf ball is struck. Stepping the elastic modulus values can affect an incoming compression wave and enables improved energy transfer at the interface or interfaces.

Examples of golf balls made according to the present disclosure are shown below:

EXAMPLE 1

Three piece ball: hollow stainless steel hardened spherical core having an elastic modulus of 193 GPa and a thickness of approximately 0.032 inches and a diameter of 0.9 inches, surrounded by a mantle layer of polyether block amide modified with 10% ceramic material dispersed within with a thickness of 0.1 inches which has an elastic modulus of 2.90 GPa, and then further surrounded by a mantle layer of polymeric resin with a thickness of 0.23 inches having an elastic modulus of 86 MPa, and covered with an ionomer cover layer with an elastic modulus of approximately 350 MPa and a thickness of 0.060 inches.

The layers and core of this three piece golf ball each have an elastic modulus within three orders of magnitude of any adjacent layer or core.

Other materials, such as polybutadiene, urethanes, and various resins may be used as layers, provided the constraint is met that no two adjacent layers or the core have more than three orders of magnitude difference in their respective elastic modulus.

EXAMPLE 2

Five piece ball: hollow stainless steel spherical core having an elastic modulus of 193 GPa and a thickness of approximately 0.032 inches and a diameter of 0.9 inches, surrounded by a first mantle layer of polyether block amide modified with 10% ceramic material dispersed within with a thickness of 0.1 inches which has an elastic modulus of 1.95 GPa, and then further surrounded by a second mantle layer of polymeric resin with a thickness of 0.18 inches having an elastic modulus of 86 MPa, and then further surrounded by a third mantle layer of polymeric resin with a thickness of 0.05 inches having an elastic modulus of 200

MPa, and covered with an ionomer cover layer with an elastic modulus of approximately 350 MPa and a thickness of 0.060 inches.

The layers and core of this five piece golf ball each have an elastic modulus within three orders of magnitude of any adjacent layer or core.

Although the present disclosure has been described with respect to one or more particular embodiments, it will be understood that other embodiments of the present disclosure may be made without departing from the scope of the present disclosure. Hence, the present disclosure is deemed limited only by the appended claims and the reasonable interpretation thereof.

What is claimed is:

1. A golf ball comprising:

a cover layer having an outer surface defining a plurality of dimples and an inner surface opposite the outer surface;

a spherical core having an outer surface disposed within the cover layer, wherein the spherical core has a stiffness of at least 1 GPa; and an innermost mantle layer and an outermost mantle layer disposed between the spherical core and the cover layer, wherein the innermost mantle layer has an inner surface disposed on the outer surface of the spherical core and the outermost mantle layer has an outer surface disposed on the inner surface of the cover layer;

wherein the spherical core and the innermost mantle layer have an elastic modulus within three orders of magnitude of each other;

wherein each of the cover layer, the outermost mantle layer, and the innermost mantle layer has an elastic modulus within three orders of magnitude of each adjacent layer.

2. The golf ball according to claim 1, wherein the spherical core comprises a hollow metal core.

3. The golf ball of claim 2, wherein the hollow metal core is fabricated of at least one of titanium, a titanium alloy, steel, stainless steel, a steel alloy, or aluminum.

4. The golf ball according to claim 1, wherein the cover layer is fabricated of at least one of an ionomer resin, urethane, balata, polybutadiene, or another synthetic elastomer, and wherein the outermost mantle layer and the innermost mantle layer include a polymer.

5. The golf ball according to claim 1, further comprising an additional mantle layer disposed between the innermost mantle layer and the outermost mantle layer, wherein the additional mantle layer has an elastic modulus within three orders of magnitude of any of the innermost mantle layer and the outermost mantle layer that the additional mantle layer is adjacent.

6. The golf ball according to claim 1, wherein the spherical core and the innermost mantle layer have an elastic modulus within two orders of magnitude of each other and wherein each of the cover layer, the outermost mantle layer, and the innermost mantle layer has an elastic modulus within two orders of magnitude of each adjacent layer.

7. The golf ball according to claim 1, wherein the spherical core and the innermost mantle layer have an elastic modulus within one-and-a-half orders of magnitude of each other and wherein each of the cover layer, the outermost mantle layer, and the innermost mantle layer has an elastic modulus within one-and-a-half orders of magnitude of each adjacent layer.

8. The golf ball according to claim 1, wherein the spherical core comprises at least one feature configured to control a vibrational response of the spherical core, wherein the at least one feature comprises at least one indentation configured to control a stiffness of the spherical core.

9. The golf ball according to claim 8, wherein the at least one indentation comprises a groove.

10. A golf ball comprising:

a cover layer having an outer surface defining a plurality of dimples and an inner surface opposite the outer surface;

a spherical core having an outer surface disposed within the cover layer, wherein the spherical core has a stiffness of at least 1 GPa, and wherein the spherical core comprises at least one feature configured to control a vibrational response of the spherical core; and an innermost mantle layer and an outermost mantle layer disposed between the spherical core and the cover layer, wherein the innermost mantle layer has an inner surface disposed on the outer surface of the spherical core and the outermost mantle layer has an outer surface disposed on the inner surface of the cover layer;

wherein the spherical core and the innermost mantle layer have an elastic modulus within three orders of magnitude of each other;

wherein each of the cover layer, the outermost mantle layer, and the innermost mantle layer has an elastic modulus within three orders of magnitude of each adjacent layer.

11. The golf ball according to claim 10, wherein the spherical core comprises a hollow metal core.

12. The golf ball of claim 11, wherein the hollow metal core is fabricated of at least one of titanium, a titanium alloy, steel, stainless steel, a steel alloy, or aluminum.

13. The golf ball according to claim 10, wherein the cover layer is fabricated of at least one of an ionomer resin, urethane, balata, polybutadiene, or another synthetic elastomer, and wherein the outermost mantle layer and the innermost mantle layer include a polymer.

14. The golf ball according to claim 10, further comprising an additional mantle layer disposed between the innermost mantle layer and the outermost mantle layer, wherein the additional mantle layer has an elastic modulus within three orders of magnitude of any of the innermost mantle layer and the outermost mantle layer that the additional mantle layer is adjacent.

15. The golf ball according to claim 10, wherein the spherical core and the innermost mantle layer have an elastic modulus within two orders of magnitude of each other and wherein each of the cover layer, the outermost mantle layer, and the innermost mantle layer has an elastic modulus within two orders of magnitude of each adjacent layer.

16. The golf ball according to claim 10, wherein the spherical core and the innermost mantle layer have an elastic modulus within one-and-a-half orders of magnitude of each other and wherein each of the cover layer, the outermost mantle layer, and the innermost mantle layer has an elastic modulus within one-and-a-half orders of magnitude of each adjacent layer.

17. The golf ball according to claim 10, wherein the at least one feature comprises at least one indentation configured to control a stiffness of the spherical core.

18. The golf ball according to claim 17, wherein the at least one indentation comprises a groove.

19. The golf ball according to claim 18, wherein at least one of the outer surface and an inner surface of the spherical core comprises a plurality of the grooves.

20. The golf ball according to claim 18, wherein both the outer surface and an inner surface of the spherical core comprise a plurality of the grooves.

* * * * *